US005193921A

United States Patent [19]

Tsukuda et al.

[11] Patent Number: 5,193,921

[45] Date of Patent: Mar. 16, 1993

[54] BRAILLE PRINTER

[75] Inventors: Yoshimi Tsukuda, Chofu; Isamu Goto, Musashino, both of Japan

[73] Assignee: Toyo Hybrid Co., Ltd., Mitaka, Japan

[21] Appl. No.: 861,638

[22] Filed: Apr. 1, 1992

[30] Foreign Application Priority Data

Jul. 26, 1991 [JP] Japan ..... 3-208943

[51] Int. Cl.[5] ..... B41J 2/22

[52] U.S. Cl. ..... 400/122; 400/82

[58] Field of Search ..... 400/82, 122, 188; 101/18

[56] References Cited

U.S. PATENT DOCUMENTS

| | | | |
|---|---|---|---|
| 3,640,368 | 2/1972 | Weinberger | 400/122 |
| 4,261,663 | 4/1981 | Grimnes | 400/122 |
| 4,692,041 | 9/1987 | Dyma et al. | 400/82 |
| 4,702,630 | 10/1987 | Igi et al. | 400/82 |
| 4,735,516 | 4/1988 | Galarneau | 400/122 |

FOREIGN PATENT DOCUMENTS

| | | | |
|---|---|---|---|
| 1452711 | 1/1989 | U.S.S.R. | 400/122 |
| 8906599 | 7/1989 | World Int. Prop. O. | 400/122 |

*Primary Examiner*—Edgar S. Burr

*Assistant Examiner*—Christopher A. Bennett

*Attorney, Agent, or Firm*—Hoffmann & Baron

[57] ABSTRACT

A braille printer that embosses braille characters by a method wherein a paper feed mechanism using a motor is disposed in the entry of a paper feed passage, a motor controler for feeding paper on which braille characters are embossed to an emboss start position according to one dot line spacing and character line spacing is mounted thereto, and the projections and recesses of both the dies at positions corresponding to the braille signals at an embossing position in the midway of the paper feed passage, wherein there are disposed a lead-edge position sensor for detecting the lead-edge position of paper is disposed in the paper-feed passage, and an obverse-/reverse-surface indicator for outputting an obverse-/reverse-surface indication signal indicating which one of either or the obverse surface or reverse surface of the paper should be printed, and an initial paper-feed controller for, in response to a detection signal from the leading-edge position sensor and the obverse-/reverse-surface indication signal, outputting an initial paper-feed termination signal to the motor controller when the paper is fed to embossing positions which are shifted from each other so that the braille characters on both sides of the paper will not overlap.

6 Claims, 5 Drawing Sheets

BRAILLE PRINTER

BACKGROUND OF THE INVENTION

1. Field of the Invention

The present invention relates to a braille printer that embosses braille characters dot line by dot line by a method wherein projections and recesses of embossing and debossing dies are pressed in response to braille signals in a state in which paper is placed between the projections and recesses thereof.

2. Description of the Related Art

In this type of braille printer, various mechanisms for pressing projections and recesses to emboss braille characters are well known. In each of these mechanisms, it is presupposed that printing is performed on only one side of the printing paper. However, if both sides can be embossed, as a matter of course, the amount of paper consumed is reduced.

SUMMARY OF THE INVENTION

The present invention has been accomplished in light of the above-described circumstances.

An object of the present invention is to provide a braille printer of the type described above which is capable of embossing both sides of the paper.

The present invention in one aspect pertains to a braille printer comprising obverse-/reverse-surface indicating means for outputting obverse-/reverse-surface indication signals indicating which of either the reverse or obverse surface of the paper should be printed; and initial paper feed controlling means for, in response to a signal indicating that the leading edge of the paper has been detected and obverse-/reverse-surface indication signals of a leading-edge position sensor, outputting an initial paper-feed termination signal to a motor controlling means when paper is fed to an embossing start position where braille characters on one side of the paper are shifted relative to those on the other side so that the braille characters are not embossed on each other; a leading-edge position sensor for detecting the leading edge position of the paper being disposed in the paper feed passage of said braille printer.

The present invention makes it possible to print braille characters on both sides of the paper. The amount of paper can be reduced considerably when character line spacing on one side is widened slightly so that they do not overlap with characters on the other side. Although, when paper is stacked, the thickness thereof increases particularly in the case of braille printing, the thickness can be reduced considerably because braille characters on the facing surfaces fall between braille characters on both sides. The amount of paper required for a given document can be reduced and it is advantageous in terms of management.

When printing on both sides of a sheet of paper, the braille characters will not overlap, if the space between the characters, which is narrower than the height of the characters in one-sided printing, is widened. Moreover, the amount of paper used in one-sided printing is not increased.

A plate spring is disposed which extends from the base end of a projection of a pressing or debossing die to the exit of a paper feed passage in a state in which it is inclined to the top end portion. This plate spring not only prevents paper jamming during one- or two-sided printing but also eliminates the danger that printed braille characters might be flattened during two-sided printing.

The aforementioned and other objects, features and advantages of the present invention will become clear when reference is made to the following description of the preferred embodiments of the present invention, together with reference to the accompanying drawings.

DETAILED DESCRIPTION OF THE PREFERRED EMBODIMENTS

Figure 1:
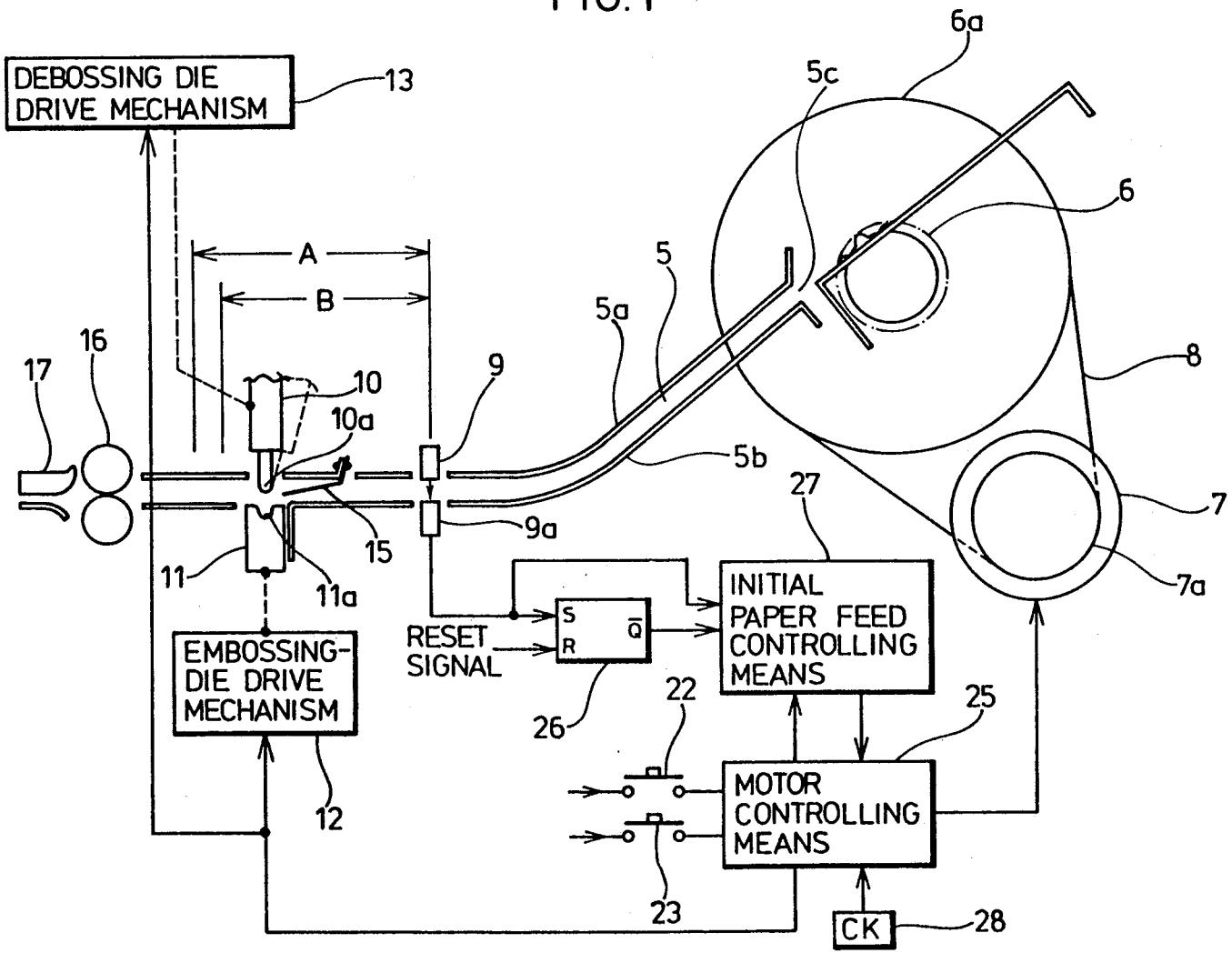
FIG. 1 is a cross-sectional view of a paper feed passage portion of a braille printer and a circuit diagram thereof according to an embodiment of the present invention.

FIGS. 1 to 4 show a braille printer of an embodiment of the present invention. As shown in FIG. 1, a paper feed passage 5 is formed between two plates **5*a* and 5*b* spaced apart which extends downward obliquely and thereafter horizontally in the interior of the braille printer 1 shown in FIG. 4. A sprocket 6, which is rotated by a stepping motor 7 via a pulley on the rotational shaft 7*a* of the stepping motor 7, a wire 8 and a pulley 6*a* on the rotational shaft, is disposed on both sides of an entry 5*c* of the paper feed passage 5, thus forming a paper feed mechanism. A light-emitting element 9 and a photoreceptor element 9*a* employed as a leading-edge position sensor for detecting the leading edge of paper 2 (FIG. 3) are disposed facing each other in the midway position of the paper feed passage 5**. Thus, the position of the leading edge of the paper is detected when the light beam is shielded.

Figure 2:
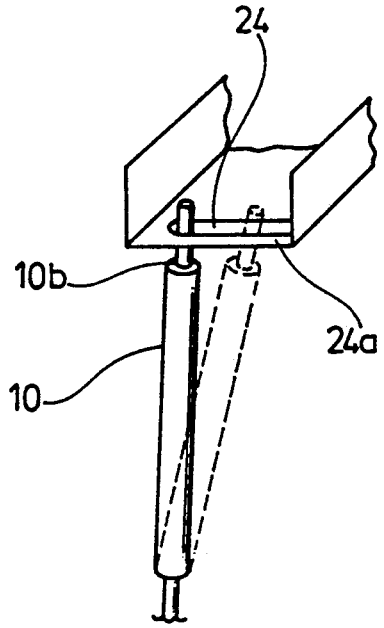
FIG. 2 is a perspective view which illustrates the operation of a debossing die of the braille printer.

A rod 10 having a pin-shaped projection **10*a*, employed as a debossing die, and an embossing die 11 in which a recess 11*a* having a corresponding shape driven upward facing this rod is formed are disposed posterior to an embossing position. An embossing die drive mechanism 12 which is operated in synchronization with paper feeding is attached to the embossing die. By contrast, a debossing-die control mechanism 13 for displacing the rod 10 from an original oblique position to a vertical position in synchronization with paper feeding similar to that described above and in response to braille signals is attached to the rod 10. As shown in FIG. 2, the top end section of the rod 10 escapes upward if it is driven upward by the embossing die 11 at the original oblique position indicated by the dotted line because the top portion is slidably inserted into an oblong hole 24, whereas if it is inclined to the position indicated by the solid line in response to braille signals, the shoulder section 10b is restricted by the stopper surface 24a** and the embossing is performed.

A sheet-like plate spring 15 which extends obliquely from the plate 5a to the top end position of the pin-shaped projection IOa is disposed at a position anterior to the rod 10. The plate spring 15 not only prevents paper jamming because the leading edge of the paper 2 fed is brought into abutment with the side of the plate spring 15, but also prevents braille characters formed on the paper 2 from being deformed by the act of these characters being brought into abutment therewith. An elastic pinch roller 16 for grasping both sides of the paper 2 is disposed posterior to the embossing position. An elastic plate 17 for grasping the paper 2 by pressing it from above is mounted for the purpose of cutting the paper 2 at perforations posterior to the roller.

Figure 4:
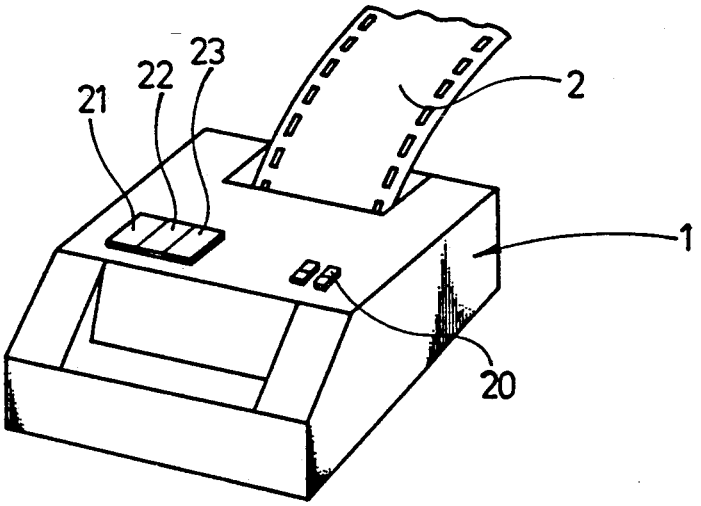
FIG. 4 is a perspective view of the exterior of the braille printer.

As shown in FIG. 4, a power-supply switch 21, a paper-feed start switch 22, a type-of-printing indication switch 23 for indicating two-sided printing and a key group 20 from which the number of continuous sheets of paper is set are arranged on the panel of the braille printer 1. A motor controlling means 25 for pulse-controlling a stepping motor 7 by accepting clock signals of a clock generator 28 as input is also attached thereto. Attached to the motor controlling means is a flip-flop 26 which functions as an obverse-reverse-surface indicating means for indicating which side of the paper should be printed when it is triggered each time the leading edge of the paper is detected by the photoreceptor 9a; and an initial paper-feed controlling means 27 for setting the embossing start position of the first character line, which is offset on either side of the paper so that braille characters are embossed on the space between braille characters of the obverse-surface during reverse-surface printing.

That is, as shown in FIG. 1, the initial paper feed amount A from the photoreceptors 9 and 9a is set in such a way that the first dot line of braille characters of the first character line on the obverse surface is positioned at the embossing position. In contrast, the initial paper feed amount B for the reverse-surface printing is set at a length of paper slightly smaller than that above for the first dot line of the braille characters inserted between the first and second character lines on the obverse surface to be positioned at an embossing position, so that the characters on both sides do not overlap.

When the paper-feed start switch 22 is operated in a state in which the paper 2 is locked by the sprocket 6, the motor controlling means 25 processes input clock signals in the circuit so that an initial paper feeding is performed first by the paper feed amount set by the initial paper-feed controlling means 27, then paper feeding in units of one dot line is performed for a one character amount, and next paper feeding is performed according to character line spacing, and outputs motor control pulses in which generation timing and pulse intervals are adjusted. Also, when the embossing of the number of sheets of paper set by the key group 20 has been terminated, the succeeding perforations are fed to the grasping plate 17 for final paper feeding. In the case of one-sided printing, space between braille characters in two lines is narrower than the height of one character, whereas it is slightly wider than the height of one character in the case of two-sided printing so that braille characters on both sides will not overlap.

The flip-flop 26 is reset when the power supply is turned on by the power-supply switch 21 and is inverted when the leading edge of the paper is detected, thereby generating level L output from the reverse output end thereof to indicate obverse-surface printing first. Next, when the leading edge of the paper is detected, the flip-flop 26 is again inverted, generating level H output to indicate reverse-surface printing.

The initial paper-feed controlling means 27 comprises, for example, a preset counter. A pulse corresponding to a unit amount of paper feeding is supplied thereto from the motor controlling means 25. A count value corresponding to the initial paper-feed amount A during obverse-surface printing or the initial paper-feed amount B during reverse-surface printing are preset in the initial paper-feed controlling means 27 depending upon which one of either L level output or H level output is input from the flip-flop 26. When the count value has been reached, the initial paper-feed controlling means 27 sends out an initial paper-feed termination signal to the motor controlling means 25.

Figure 5:
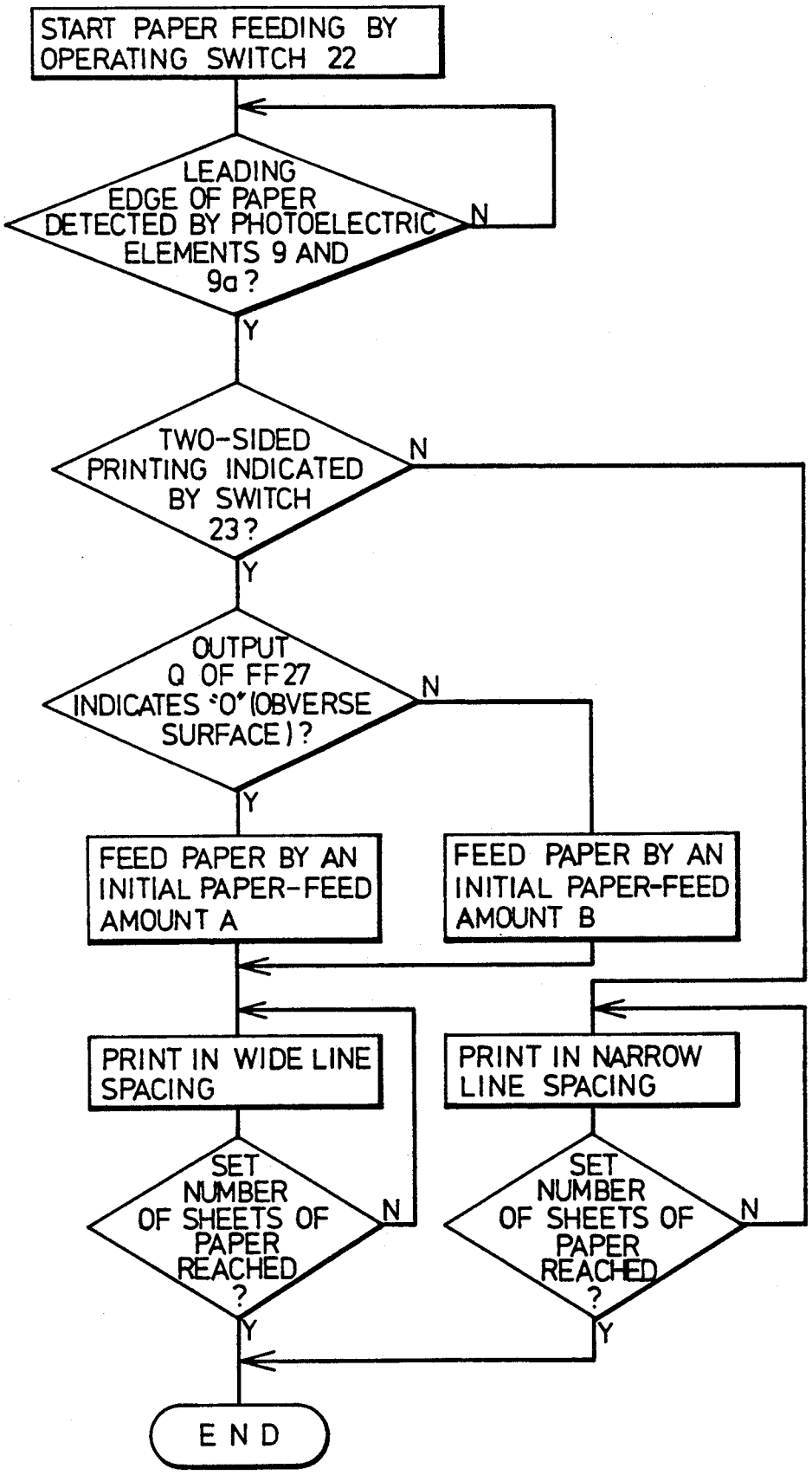
FIG. 5 is a flowchart which illustrates the operation of the braille printer.

The operation of the braille printer constructed as described above will now be explained with reference to the flowchart in FIG. 5.

The power-supply switch 21 is turned on. The paper 2 is set to the sprocket 6 with the obverse surface thereof facing downward. The type-of-printing indication switch 23 is operated, and then the paper-feed start switch 22 is operated. When the leading edge of the paper is detected by the photoreceptor element 9a because light is shielded, the initial paper-feed controlling means 27 starts counting and sends out the initial paper-feed termination signal to the motor controlling means 25 when the initial paper-feed amount A has been reached because the output signal of the flip-flop 26 is turned to level L. Thereupon, the embossing-die drive mechanism 12 and the debossing-die control mechanism 13 cause the projections and recesses of the rod 10 which is vertically inclined and the embossing die 11 to be engaged with and pressed against each other in response to the braille signals, and the embossing of one dot line is performed.

Figure 3:
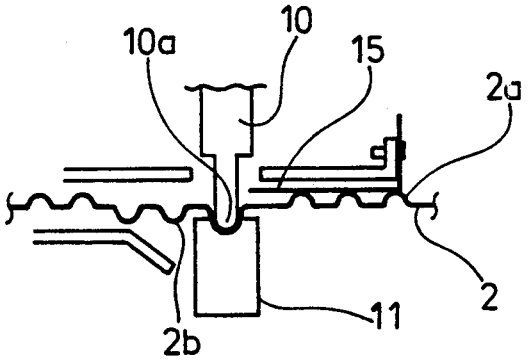
FIG. 3 is a cross-sectional view which illustrates an embossed condition by the braille printer.

Thereafter, one line of braille characters is successively printed while the paper is fed in one dot line spacing or character line spacing by the motor controlling means 25. For instance, after the set obverse-surface printing of page five is performed, the perforation of that page is sent to the grasping plates 17 in the top end section and the paper is pressed there and cut out. Then, the paper is set again to the sprocket 6 with the obverse surface of the paper facing downward, and the paper-feed start switch 22 is operated. Thereupon, the initial paper-feed controlling means 27 is preset to the initial paper-feed amount B since the output signal of the flip-flop 26 is turned to level H in contrast to that described above and starts counting when the leading edge of the paper has been detected. When the preset value is reached, printing of the reverse-surface is started. On that occasion, as shown in FIG. 3, a braille character 2a on the printed surface of the paper 2 lightly pushes up the plate spring 15 during embossing and a braille character 2b on the reverse surface is embossed. After that, the paper 2 is lightly pressed downward by the plate spring 15, and the braille character 2a is brought into abutment with the pin-shaped projection 10a during paper feeding. As a result, the paper is not deformed.

In the case of two-sided printing, it is also possible to set the paper 2 for each side and to print on the reverse surface for each printing. When the type-of-printing indication switch 23 for indicating two-sided printing is not set, printing is performed in narrow character line spacing, and the initial paper-feed controlling means 27 constantly indicates the initial paper-feed amount A during such time.

It may be thought in the above-described embodiment that an indication of an obverse-surface or reverse-surface printing is made by a manual operation by replacing the obverse-/reverse-surface indicating means with the manually operated switch without using a circuit causing signals to be generated automatically. The photoreceptor elements 9 and 9*a* are disposed at the leading edge of the paper at the start of embossing on the reverse surface a little farther than the rod 10, which is an embossing position. An initial paper-feed termination signal for the reverse surface can be generated by the initial paper-feed controlling means when the leading edge of the paper is detected. An initial paper-feed termination signal for the obverse surface can also be generated after a predetermined time has elapsed from when the leading edge of the paper has been detected. Although the first character line of the reverse surface is positioned in the space between the first and second characters of the obverse surface, it may be thought that the first character line of the reverse surface is positioned in the portion before the first character line of the obverse surface. In the above-described embodiment, the vertical position of the rod is restricted and the matrix is vertically driven. In contrast, the matrix may be fixed in position, and it can be applied to an embossing mechanism for moving the rod vertically.

Figure 6:
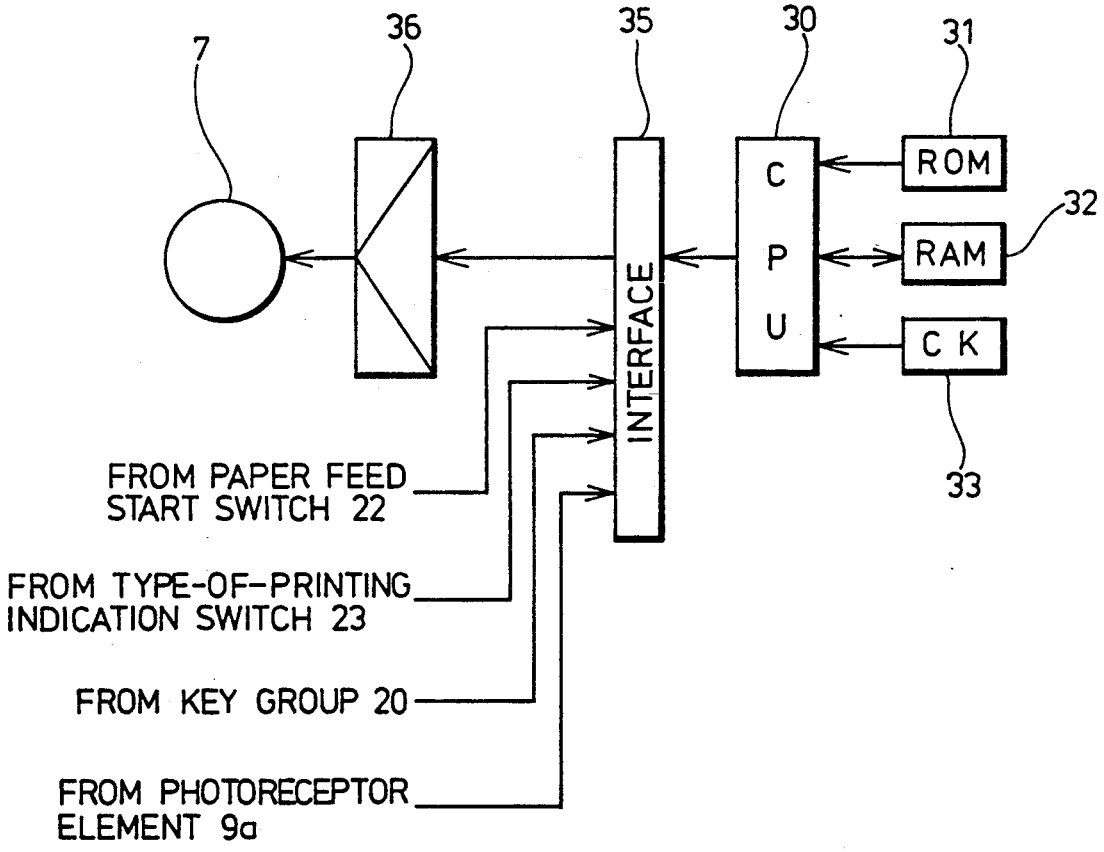
FIG. 6 is a view which illustrates the circuit arrangement of a braille printer according to another embodiment of the present invention.

FIG. 6 shows another embodiment in which the above-mentioned obverse-/reverse-surface indication means, initial paper-feed controlling means, and motor controlling means are constructed by using a CPU. That is, the operation signals of the switches 22 and 23, the set signals of the key group 20, and the detection signals of the photoreceptor element 9*a* described above are supplied to a CPU 30 via an interface section 35. A pulse control operation is performed so that the flowchart operations shown in FIG. 5 are performed according to a program written in a ROM 31 while the clock signals of the clock generator 33 are input and a RAM 32 is being used as a work area. That is, motor control pulses are generated such that an initial paper feeding of a paper length stroke according to the obverse or reverse surface is performed; next, the feeding of paper in units of one dot line is performed by an amount equal to one character line of braille characters, then the feeding of paper in character line spacing according to the obverse-/reverse-surface printing is performed and a final paper feeding is performed after a set number of sheets of paper is printed. The pulses are output to the stepping motor 7 through a pulse amplification circuit 36.

Figure 7:
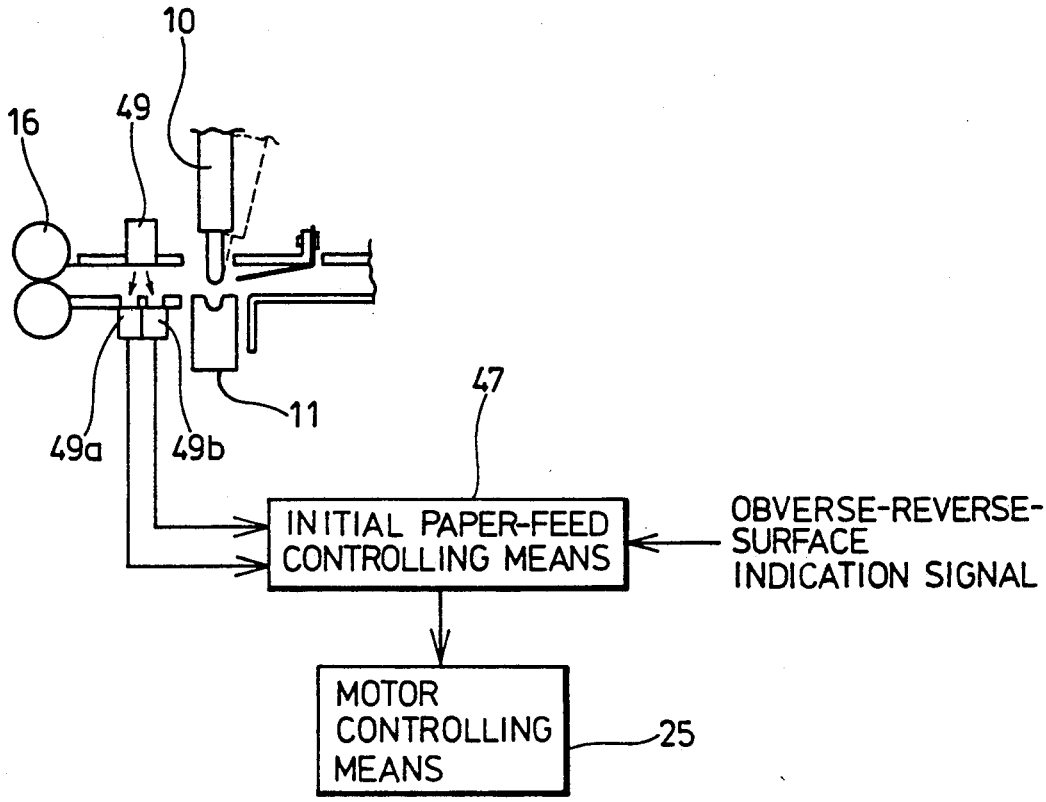
FIG. 7 is a view which illustrates the construction of an essential portion of a braille printer of still another embodiment of the present invention.

FIG. 7 shows still another embodiment of the present invention. A common light-emitting element 49 posterior to the embossing position, a photoreceptor element 49*a* disposed at the leading edge of the paper on the obverse surface at embossing start time and a photoreceptor element 49*b* which is shifted by one character line on the reverse surface are disposed in the braille printer shown in FIG. 1 in place of the photoelectric conversion elements 9 and 9*a*. Those parts having the same reference numeral as in FIG. 1 indicate the same or identical parts. Reference numeral 47 denotes an initial paper-feed controlling means. This means 47 outputs an initial paper-feed termination signal to the motor controlling means 25 when the photoreceptor element 49*a* generates a detection signal when the obverse surface is indicated in response to an obverse/-reverse-surface indication signal. In contrast, when the reverse surface is indicated, the initial paper-feed controlling means 47 outputs an initial paper-feed termination signal when the photoreceptor element 49*b* generates a detection signal. It may be thought that the obverse-/reverse-surface indicating means for outputting obverse-/reverse-surface indication signals uses the output signals of the flip-flop 26 with the photoreceptor elements 9 and 9*a* described above employed as a sensor for detecting the presence or absence of paper in a manner similar to that described above, or the flip-flop 26 is operated by a detection signal of the photoreceptor element 9*b* anterior to the photoreceptor elements 9 and 9*a*.

Figure 8:
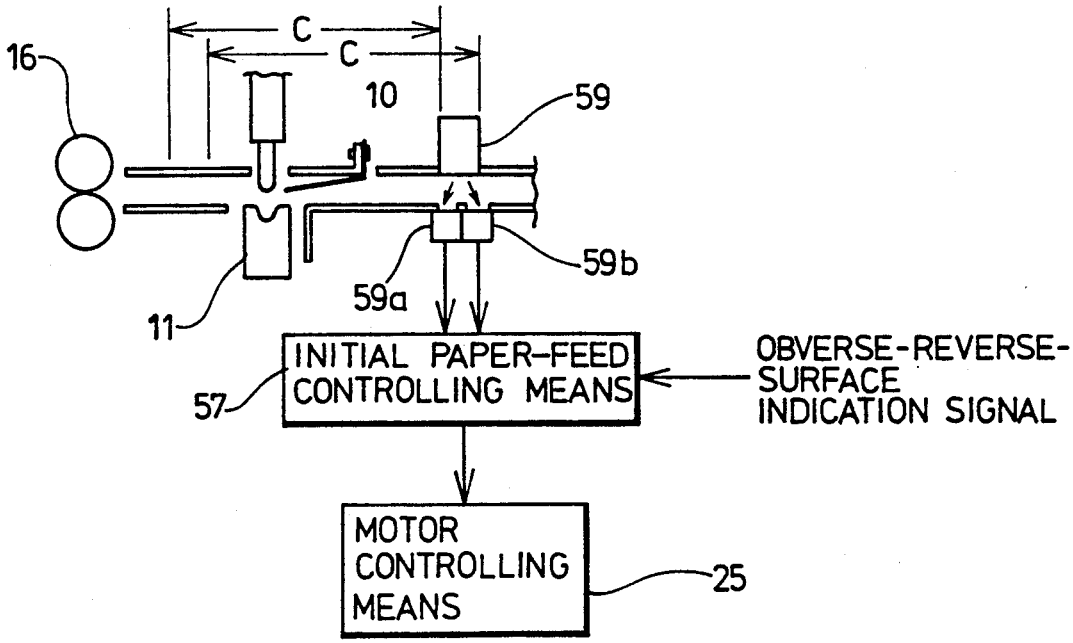
FIG. 8 is a view which illustrates the construction of an essential portion of a braille printer of yet still another embodiment of the present invention.

FIG. 8 shows yet still another embodiment of the present invention. The photoreceptor elements 9 and 9*a* are replaced with a common light-emitting element 59, a photoreceptor element 59*a* disposed at the leading edge of the paper on the obverse surface at embossing start time, and a photoreceptor element 59*b* whose position is shifted by one character line on the reverse surface. In this case, an initial paper-feed controlling means 57 outputs an initial paper-feed termination signal to the motor controlling means 25 when the paper is fed by the paper length C shown in FIG. 8 from the time when the photoreceptor element 59*a* or 59*b* selected in response to the obverse-/reverse-surface indication signal generates a detection signal.

Many different embodiments of the present invention may be constructed without departing from the spirit and scope of the present invention. It should be understood that the present invention is not limited to the specific embodiments described in this specification. To the contrary, the present invention is intended to cover various modification and equivalent arrangements included with the spirit and scope of the claims. The following claims are to be accorded a broad interpretation, so as to encompass all such modifications and equivalent structures and functions.

What is claimed is:

1. A braille printer, comprising:

means defining a paper feed passage for passing paper therethrough, the paper feed passage being further defined with an entry and an exit;

a paper feed mechanism having a motor and being disposed in the entry of the paper feed passage;

motor controlling means for controlling said motor to feed paper onwhich braille characters are embossed to an embossing start position, according to one dot line spacing and character line spacing;

a plurality of embossing and debossing dies facing each other being arranged in the form of a line at an embossing position approximately midway down the paper feed passage, each embossing die having at least one of a recess and a projection, and each debossing die having at least one of a projection and a recess;

the projections and recesses of the embossing and debossing dies being pressed together in response to braille signals in synchronization with the paper feed controlled by said motor controlling means, whereby an embossing of braille characters is performed on the paper by the embossing and debossing dies;

at least oen leading-edge position sensor, disposed in the paper feed passage, for detecting the lead-edge position of the paper, the at least one leading-edge position sensor generating a detection signal;

obverse-/reverse-surface indicating means for outputting an obverse-/reverse-surface indication signal indicating which one of either the obverse surface or reverse surface of the paper should be printed; and initial paper-feed controlling means for, in response to the detection signal from the leading-edge position sensor and to the obverse-/reverse-surface indication signal, outputting an initial paper-feed termination signal to the motor controlling means when the paper is fed to an embodding position which is offset relative to the braille characters on the other side of the paper so that said characters will not overlap.

2. A braille printer according to claim 1, wherien the leading-edge position sensor is disposed, and initial paper-feed controlling means generates an initial paper-feed termination signal after a lapse of predetermined times, different for the obverse and reverse surfaces, from when the leading-edge position sensor has generated the detection signal.

3. A braille printer according to claim 1, wherein two leading-edge position sensors are disposed offset by a space corresponding to the deviation of the embossing start positions on either side of the paper being embossed, and the initial paper-feed controlling means outputs an initial paper-feed termination signal when the leading-edge position sensor on the side corresponding to the obverse-/reverse-surface indication signal, generates a detection signal.

4. A braille printer according to claim 1, wherein two leading-edge position sensors are disposed offset by a space corresponding to the deviation of the embossing start positions on either side of the paper being embossed, and the initial paper-feed controlling means outputs an initial paper-feed termination signal after a lapse of a predetermined time from when the leading-edge position sensor on the side corresponding to the obverse-/reverse-surface indication signal, generates a detection signal.

5. A braille printer according to claim 1, which further comprises type-of-printing indicating means for outputting a type-of-printing indication signal indicating either one- or two-sided printing, the type-of-printing indicating means being operatively coupled to the motor controlling means, and wherein the motor controlling means controls the incremental amount the paper is fed into the paper feed passage in response to the type-of-printing indication signal to thereby control the spacing between braille characters printed on the paper.

6. A braille printer according to claim 1, which further comprises a plate spring, the plate spring being disposed in the paper feed passage between the embossing position of the embossing and debossing dies and the entry of the paper feed passage and extending obliquely in the paper feed passage.

* * * * *

UNITED STATES PATENT AND TRADEMARK OFFICE

CERTIFICATE OF CORRECTION

PATENT NO. : 5,193,921

DATED : March 16, 1993

INVENTOR(S) : Yoshimi Tsukuda and Isamu Goto

It is certified that error appears in the above-identified patent and that said Letters Patent is hereby corrected as shown below:

Column 6, line 67, after "least", change "oen" to --one--.

Column 7, line 13, before "position", change "embodding" to --embossing--.

Signed and Sealed this

Seventh Day of December, 1993

*Attest:*

*Attesting Officer*

BRUCE LEHMAN

*Commissioner of Patents and Trademarks*